US008237115B2

(12) United States Patent
Kovtoun et al.

(10) Patent No.: US 8,237,115 B2
(45) Date of Patent: Aug. 7, 2012

(54) METHOD AND APPARATUS FOR MULTIPLE ELECTROSPRAY EMITTERS IN MASS SPECTROMETRY

(75) Inventors: Viatcheslav V. Kovtoun, Santa Clara, CA (US); Eloy R. Wouters, San Jose, CA (US); R. Paul Atherton, San Jose, CA (US)

(73) Assignee: Thermo Finnigan LLC, San Jose, CA (US)

( * ) Notice: Subject to any disclaimer, the term of this patent is extended or adjusted under 35 U.S.C. 154(b) by 434 days.

(21) Appl. No.: 12/642,617

(22) Filed: Dec. 18, 2009

(65) Prior Publication Data

US 2011/0147577 A1 Jun. 23, 2011

(51) Int. Cl.
*H01J 49/00* (2006.01)

(52) U.S. Cl. ..... 250/288; 250/281; 250/282; 250/283; 250/423 R; 250/424; 250/425

(58) Field of Classification Search ..... 250/281–283, 250/288, 423 R, 424, 425
See application file for complete search history.

(56) References Cited

U.S. PATENT DOCUMENTS

| | | | | |
|---|---|---|---|---|
| 6,245,227 | B1 | 6/2001 | Moon et al. | |
| 6,831,274 | B2 | 12/2004 | Smith et al. | |
| 2003/0111599 | A1 | 6/2003 | Staats | |
| 2003/0143493 | A1 | 7/2003 | Schultz et al. | |
| 2003/0201390 | A1 | 10/2003 | Corso et al. | |
| 2006/0208186 | A1 * | 9/2006 | Goodley et al. | 250/288 |
| 2009/0056133 | A1 * | 3/2009 | Waits et al. | 29/890.143 |
| 2009/0230296 | A1 | 9/2009 | Kelly et al. | |
| 2009/0294660 | A1 * | 12/2009 | Whitehouse et al. | 250/288 |

FOREIGN PATENT DOCUMENTS

WO WO 2009/023257 A1 2/2009

OTHER PUBLICATIONS

Kelly et al., "Nanoelectrospray Emitter Array Providing Interemitter Electric Field Uniformity," Anal. Chem. (2008), vol. 80, pp. 5660-5665.
Rulison et al., "Scale-up of Electrospray Atomization Using Linear Arrays of Taylor Cones," Rev. Sci. Instrum. 64 (3), Mar. 1993, pp. 683-686.
Regele et al., "Effects of Capillary Spacing on EHD Spraying from an Array of Cone Jets," Journal of Aerosol Science 33 (2000), pp. 1471-1479.
Si et al., "Experimental and Theoretical Study of a Cone-Jet for an Electrospray Microthruster Considering the Interference Effect in an Array of Nozzles," Journal of Aerosol Science 38 (2007), pp. 924-934.
Deng et al., "Compact Multiplexing of Monodisperse Electrosprays," Journal of Aerosol Science 40 (2009), pp. 907-918.

* cited by examiner

*Primary Examiner* — Jack Berman
*Assistant Examiner* — Meenakshi Sahu
(74) *Attorney, Agent, or Firm* — Thomas F. Cooney

(57) ABSTRACT

An electrospray ion source apparatus comprises: a plurality of emitter capillaries, each comprising an internal bore for transporting a portion of a liquid sample from a source, an electrode portion for providing a first applied electric potential and an emitter tip for emitting charged particles generated from the liquid sample portion; a counter electrode for providing a second applied electric potential different from the first applied electric potential; and at least one shield electrode disposed at least partially between the counter electrode and the emitter tip of at least one of the emitter capillaries for providing a third applied electric potential intermediate to the first and second applied electric potentials, wherein the at least one shield electrode is configured such that provision of the third applied electric potential to the at least one shield electrode provides a uniformity of emission of charged particles from the plurality of emitter tips.

28 Claims, 13 Drawing Sheets

METHOD AND APPARATUS FOR MULTIPLE ELECTROSPRAY EMITTERS IN MASS SPECTROMETRY

FIELD OF THE INVENTION

The present invention relates to ionization sources for mass spectrometry and, in particular, to an electrospray ionization source comprising a plurality of separate ion emitters.

BACKGROUND OF THE INVENTION

The well-known technique of electrospray ionization is used in mass spectrometry to generate free ions. The conventional electrospray process involves breaking the meniscus of a charged liquid formed at the end of the capillary tube into fine droplets using an electric field. In conventional electrospray ionization, a liquid is pushed through a very small charged capillary. This liquid contains the analyte to be studied dissolved in a large amount of solvent, which is usually more volatile than the analyte. An electric field induced between the capillary electrode and the conducting liquid initially causes a Taylor cone to form at the tip of the tube where the field becomes concentrated. Fluctuations cause the cone tip to break up into fine droplets which are sprayed, under the influence of the electric field, into a chamber at atmospheric pressure in the presence of drying gases. An optional drying gas, which may be heated, may be applied so as to cause the solvent in the droplets to evaporate. According to a generally accepted theory, as the droplets shrink, the charge concentration in the droplets increases. Eventually, the repulsive force between ions with like charges exceeds the cohesive forces and the ions are ejected (desorbed) into the gas phase. The ions are attracted to and pass through a capillary or sampling orifice into the mass analyzer.

Incomplete droplet evaporation and ion desolvation can cause high levels of background counts in mass spectra, thus causing interference in the detection and quantification of analytes present in low concentration. It has been observed that smaller initial electrospray droplets tend to be more readily evaporated and, further, that droplet sizes decrease with decreasing flow rate. Thus, it is desirable to reduce the flow rate per emitter and, consequently, the droplet size, as much as possible (on the order of microliters or even nanoliters per minute) in order to spectra with minimal background interference. However, conventional electrospray devices and conventional liquid chromatography apparatuses which deliver eluent to such electrospray devices are typically associated with flow rates of several microliters per minute up to 1 ml per minute. It is therefore of interest to use assembly or array of multiple nanospray or microspray emitters with the goal to generate more ions per unit volume of analyte solvent while still realizing low flow rates per each emitter.

Attempts have been made to manufacture an electrospray device which produces nanoelectrospray. For example, Wilm and Mann, Anal. Chem. 1996, 68, 1-8 describes the process of electrospray from fused silica capillaries drawn to an inner diameter of 2-4 μm at flow rates of 20 mL/min. Specifically, a nanoelectrospray at 20 mL/min was achieved from a 2 μm inner diameter and 5 μm outer diameter pulled fused-silica capillary with 600-700 V at a distance of 1-2 mm from the ion-sampling orifice of an API mass spectrometer. Other nano-electrospray devices have been fabricated from substantially planar substrates with microfabrication techniques that have been borrowed from the electronics industry and microelectromechanical systems (MEMS), such as chemical vapor deposition, molecular beam epitaxy, photolithography, chemical etching, dry etching (reactive ion etching and deep reactive ion etching), molding, laser ablation, etc.

In order to realize the aforementioned benefits of micro-electrospray or nano-electrospray at higher overall flow rates, electrospray arrays of densely packed tubes or nozzles have been developed, using either capillary pulling or microfabrication and MEMS techniques, so as to increase the overall flow rate without affecting the size of the ejected droplets. For example, FIG. 1A illustrates an array of fused-silica capillary nano-electrospray ionization emitters arranged in a circular geometry, as taught in United States Patent Application Publication 2009/0230296 A1, in the names of Kelly et al. Each nano-electrospray ionization emitter 2 comprises a fused silica capillary having a tapered tip 3. As taught in United States Patent Application Publication 2009/0230296 A1, the tapered tips can be formed either by traditional pulling techniques or by chemical etching and the radial arrays can be fabricated by passing approximately 6 cm lengths of fused silica capillaries through holes in one or more discs 1. The holes in the disc or discs may be placed at the desired radial distance and inter-emitter spacing and two such discs can be separated to cause the capillaries to run parallel to one another at the tips of the nano-electrospray ionization emitters and the portions leading thereto.

In order to introduce ions generated by a multi-emitter electrospray apparatus into a mass spectrometer (MS), the simplest approach would be to locate the several emitters at sufficient distances from one other such that electric fields from any given emitter do not measurably affect the operation of any other emitter and provide a separate ion inlet into the mass spectrometer for each emitter. This approach is not generally practical because of the requirement of proportionally higher evacuation pumping speed with an increase in the number of emitters and ion inlets. A preferable approach is to use a standard vacuum interface (single ion inlet to the mass spectrometer, such as the entrance orifice of the ion transfer tube) while locating and configuring the emitters in such a way that the transmission efficiency into the single ion inlet is close to optimized. Normally, a liquid jet with charged droplets emanating from an emitter tip occupies space roughly represented by cone with an 80-90 degree angle at the apex (at the emitter tip). The optimal emitter position, relative to an MS ion inlet, is therefore a compromise between the competing requirements of efficient sample transfer into the ion inlet and efficient sample de-solvation. To accomplish efficient sample transfer, the distance between the emitter capillary and the ion inlet should be short and the axis of the emitter should be directed towards the ion inlet. On the other hand, to accomplish efficient de-solvation, a longer travel distance to the inlet is required. For a single emitter, the optimal distance is found to be between 2 to 4 mm, resulting in a 4-8 mm diameter ion plume at the inlet plane.

The above considerations suggest that, if multiple electrospray emitters are employed instead of a single emitter, these should all be positioned as close as possible to the position of the single emitter that they replace. Unfortunately, placing muliple emitters in random stack or arranged in regular pattern in the rather limited volume near the vacuum interface has had limited success, in practice. One of the reasons for such limited success is the interference of the electric fields originating from the various emitters, when packed into the requisite small space. This effect has been theoretically modeled by Si et al. ("Experimental and theoretical study of a cone-jet for an electrospray microthruster considering the interference effect in an array of nozzles", Journal of Aerosol Science 38, 2007, pp. 924-934) who demonstrated that, for an array of closely-spaced emitters operating simultaneously, the operating voltage required for cone jet spraying increases as the emitter spacing decreases. Regele et al. ("Effects of capillary spacing on EHD spraying from an array of cone jets", Journal of Aerosol Science 33, 2002, pp. 1471-1479) experimentally determined similar results for an array of four electrospray capillaries and mathematically predicted the same behavior for a 5×5 square array. Regele et al. also found that, at very close spacings (3-4 capillary diameters), the electric potential required for stable electrospray operation can decrease and postulated that fine wire electrodes interspersed among the capillaries could improve operation. Also, space charge clouds produced by individual cone jets contribute to interference effects.

Recently, Deng et al. ("Compact multiplexing of monodisperse electrosprays", Journal of Aerosol Science 40, 2009, pp. 907-918) have described a microfabricated planar nozzle array system, schematically illustrated in FIG. 1B, capable of being fabricated with a packing density of up to 11,547 sources/cm$^2$. The Deng et al. apparatus (FIG. 1B) comprises a reservoir 4 used to distribute an analyte bearing liquid to an array of electrospay nozzles 5, held at an electric potential V1, so as to form Taylor cones 6 and emit jets through apertures in a separate planar extractor electrode 7, held at a second electric potential V2. The apertures in the extractor electrode 7 are aligned with respective nozzles 5 and the gap between the extractor electrode and the nozzle tips is comparable to the nozzle diameter and spacing. The apparatus further comprises a collector electrode 8 held at a potential V3. The applied potentials are such that V1>V2>V3 (with V3 typically being ground potential). Deng et al. note that the extractor electrode 7 both localizes the electric field and shields the jet region (between the nozzles 5 and the extractor electrode 7) from the spray region (between the extractor electrode and the collector electrode 8).

In FIG. 2, interference effects between emitters of a conventional emitter array are shown based on distortion in equipotential (iso-electric potential) surface shapes when multiple emitters present. Each of FIGS. 2A-2C is a cross section through a conventional electrospray apparatus comprising one or more emitter capillary electrodes 10*a*-10*c*, and a counter electrode 12, 14, 16 comprising one or more apertures 11*a*-11*e* through which emitted ions pass on a path to a mass spectrometer ion inlet. Solid arrows in FIG. 2 represent calculated ion trajectories for m/z=+508 ions emitted in a cone with 25 degrees semi angle. Dashed lines in FIG. 2 represent calculated equipotential surfaces at 250 Volt intervals. These calculations were performed using SIMION 3-D, version 8.0.4 ion optics modeling software (available from Scientific Instrument Services of Ringoes, N.J.). The calculations employed a 2 dimensional grid with 200 grid units per millimeter around electrospray emitter capillaries having inner diameters of 100 μm, outer diameters 230 μm and energized at 2.0 kiloVolt, 3.0 mm away from a grounded counter electrode. The spacing between emitter capillaries was set at 2.5 mm. FIGS. 2A, 2B and 2C show the calculated results for the case of a single emitter, three emitters in a line and five emitters in a line, respectively. The dashed lines shown in FIGS. 2A-2C represent the intersection of three dimensional iso-potential surfaces with the cross-sectional plane of the diagrams.

The calculated results presented in FIGS. 2A-2C clearly demonstrate that attempts to place emitters in close mutual proximity (for instance, with an inter-emitter distance close to or smaller than the emitter—inlet distance) result in off-axis deflection of ions emitted from peripheral emitters, thereby possibly leading to decreased transmission efficiency into a mass spectrometer. Further, the electric field at the outermost emitters is stronger relative to the field at the central or innermost emitters. Because of the variation of electric field strength across the array, electrospraying conditions will be different for the different emitters. The different electrospray conditions may include non-uniformity of rates of emission among a plurality of emitters, non uniformity of direction of emitted particles among the various emitters, and even non-uniformity in kinetic energy of emitted ions comprising a single mass-to-charge ratio (m/z). These inconsistencies may possibly causing inconsistent or noisy experimental results.

Although the apparatus described by Deng et al. (FIG. 1B) appears to perform adequately in many situations, the present inventors have determined that the planar extractor electrode utilized in that apparatus does not provide the optimal shielding between the separate electrospray emitters of an array. Thus, the present invention addresses the need for an optimized shield electrode configuration.

SUMMARY OF THE INVENTION

In order to address the above identified limitations in the art, the present teachings provide methods and apparatuses for eliminating above mentioned interference effects between closely spaced electrospray emitters of an array (a plurality) of emitters. The present inventors have determined that supplementary "shield" electrodes disposed between and partially around emitters, optionally supported by post like supports (which themselves may comprise electrodes or portions of the electrodes), wherein the shield electrodes are configured so as to spatially conform to (or approximately conform to) the electric field that would surround an individual emitter in isolation, can provide optimal de-coupling between the various emitters. The shapes and positions of these shield electrodes may be optimized such that each emitter in the array is caused to emulate the operating conditions of a single emitter operating in isolation. Such a configuration can enable fabrication of yet-more-closely spaced emitter arrays without significant interference between emitters and with uniform voltage applied across multi-emitter array, needing no increased voltage for near-to-center emitters as in non-shielded configurations.

Accordingly, in a first aspect, an electrospray ion source for generating ions from a liquid sample for introduction into a mass spectrometer is provided. The electrospray ion source may comprise: an emitter capillary comprising an internal bore for transporting the liquid sample from a source, an electrode portion for providing a first applied electric potential and an emitter tip for emitting charged particles generated from the liquid sample; a counter electrode for providing a second applied electric potential different from the first applied electric potential; and a shield electrode disposed at least partially between the counter electrode and the emitter tip of the emitter capillary for providing a third applied electric potential intermediate to the first and second applied electric potentials, the shield electrode contoured in the form of a portion of an electric equipotential surface formed, in the absence of the shield electrode, under application of the first and second applied electric potentials to the electrode portion of the emitter capillary and to the counter electrode, respectively.

In a second aspect, there is provided an electrospray ion source apparatus for generating ions from a liquid sample for introduction into a mass spectrometer. The electrospray ion source apparatus may comprise: a plurality of emitter capillaries, each comprising an internal bore for transporting a portion of the liquid sample from a source, an electrode portion for providing a first applied electric potential and an emitter tip for emitting charged particles generated from the liquid sample portion; a counter electrode for providing a second applied electric potential different from the first applied electric potential; and one or more shield electrodes, each shield electrode disposed at least partially between the counter electrode and the emitter tip of at least one of the emitter capillaries for providing a third applied electric potential intermediate to the first and second applied electric potentials, wherein the one or more shield electrodes are configured such that provision of the third applied electric potential to the one or more shield electrodes provides a uniformity of emission of charged particles from the plurality of emitter tips.

In a third aspect, a method for providing ions to a mass spectrometer is provided. The method may comprise the steps of: (a) providing a source of analyte-bearing liquid; (b) providing a plurality of an electrospray emitter capillaries, each comprising an internal bore for transporting the analyte-bearing liquid from the source, an electrode portion and an emitter tip for emitting charged particles generated from the analyte-bearing liquid; (c) providing a counter electrode; (d) providing one or more shield electrodes, each shield electrode disposed at least partially between the counter electrode and the emitter tip of at least one of the emitter capillaries; (e) distributing the analyte-bearing liquid among the plurality of electrospray emitter capillaries; and (f) providing first, second and third electric potentials, respectively, to the plurality of electrode portions of the electrospray emitter capillaries, the counter electrode and the one or more shield electrodes, wherein the third electric potential is intermediate to the first and second electric potentials, such that the charged particles are emitted from each of the emitter tips, wherein the one or more shield electrodes are configured such that provision of the third electric potential provides a uniformity of emission of charged particles from the plurality of emitter tips.

In another aspect, a method for providing an electrospray ion emitter apparatus is provided, the method comprising: (a) providing a first emitter capillary comprising an internal bore; an electrode portion and an emitter tip; (b) providing a counter electrode at a distance from the emitter tip; (c) determining a form of an electrical equipotential surface created around the electrospray emitter capillary under application of a first and a second electric potential to the electrode portion of the electrospray emitter capillary and to the counter electrode, respectively; (d) providing at least one additional emitter capillary disposed parallel to the first emitter capillary, each additional emitter capillary comprising an internal bore, an electrode portion and an emitter tip; and (e) providing at least one shield electrode, each shield electrode approximating a portion of the form of the electrical equipotential surface and disposed at least partially between the counter electrode and the emitter tip of the first emitter capillary or the at least one additional emitter capillary.

One useful benefit of the present teachings is improved operation of multi-emitter electrospray apparatuses. In accordance with the present teachings, each emitter may be associated with a respective shielding electrode shaped as one of the equipotential surfaces of a single stand alone emitter. Therefore, even when multiple emitters are present, the local field environment around each emitter is the same as if it were operating just by itself. Thus, operational conditions may be implemented in which cross-talk or electric field interference between individual emitters is significantly reduced and the degree of uniformity of emission from several emitters is increased. In the present invention, this improvement in the uniformity of emission is accomplished without the need to apply higher voltages to some emitters, thereby reducing or eliminating electrical breakdown issues and eliminating the need for additional or costly power supplies, extra electrical shielding, etc. This allows for a denser packaging of emitters in close proximity to the vacuum interface of a mass spectrometer, thereby resulting in more efficient ion transfer similar to the one in single emitter geometry.

BRIEF DESCRIPTION OF THE DRAWINGS

The above noted and various other aspects of the present invention will become apparent from the following description which is given by way of example only and with reference to the accompanying drawings, not drawn to scale, in which.

DETAILED DESCRIPTION

The present invention provides improved methods and apparatus for providing multiple electrospray emitters in mass spectrometry. The following description is presented to enable one of ordinary skill in the art to make and use the invention and is provided in the context of a particular application and its requirements. It will be clear from this description that the invention is not limited to the illustrated examples but that the invention also includes a variety of modifications and embodiments thereto. Therefore the present description should be seen as illustrative and not limiting. While the invention is susceptible of various modifications and alternative constructions, it should be understood that there is no intention to limit the invention to the specific forms disclosed. On the contrary, the invention is to cover all modifications, alternative constructions, and equivalents falling within the essence and scope of the invention as defined in the claims. To more particularly describe the features of the present invention, please refer to FIGS. 2-7 in conjunction with the discussion below.

Figure 1A:
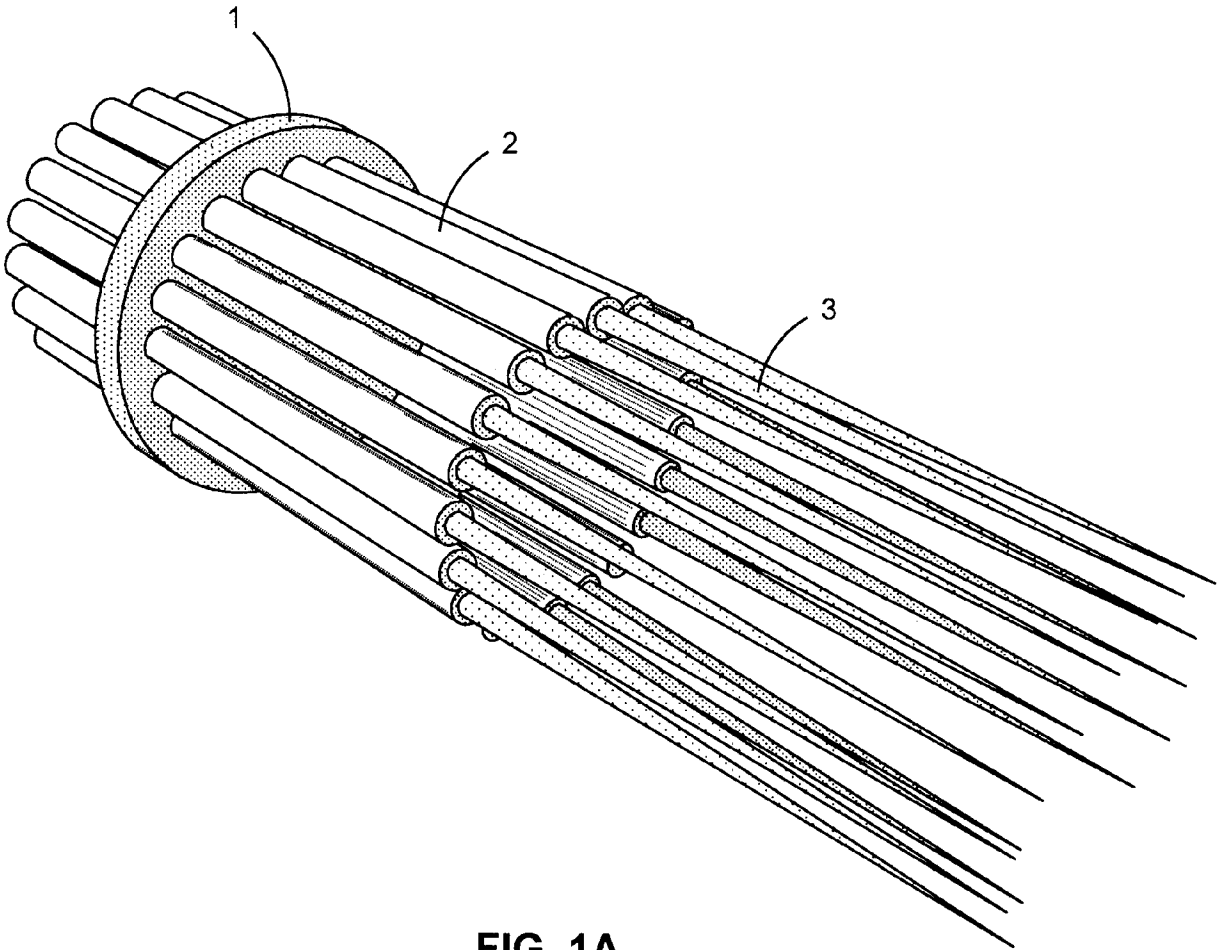
FIG. 1A (Prior Art)
FIG. 1A illustrates an example of a known array of fused-silica capillary nano-electrospray ionization emitters arranged in a circular geometry.
Figure 1B:
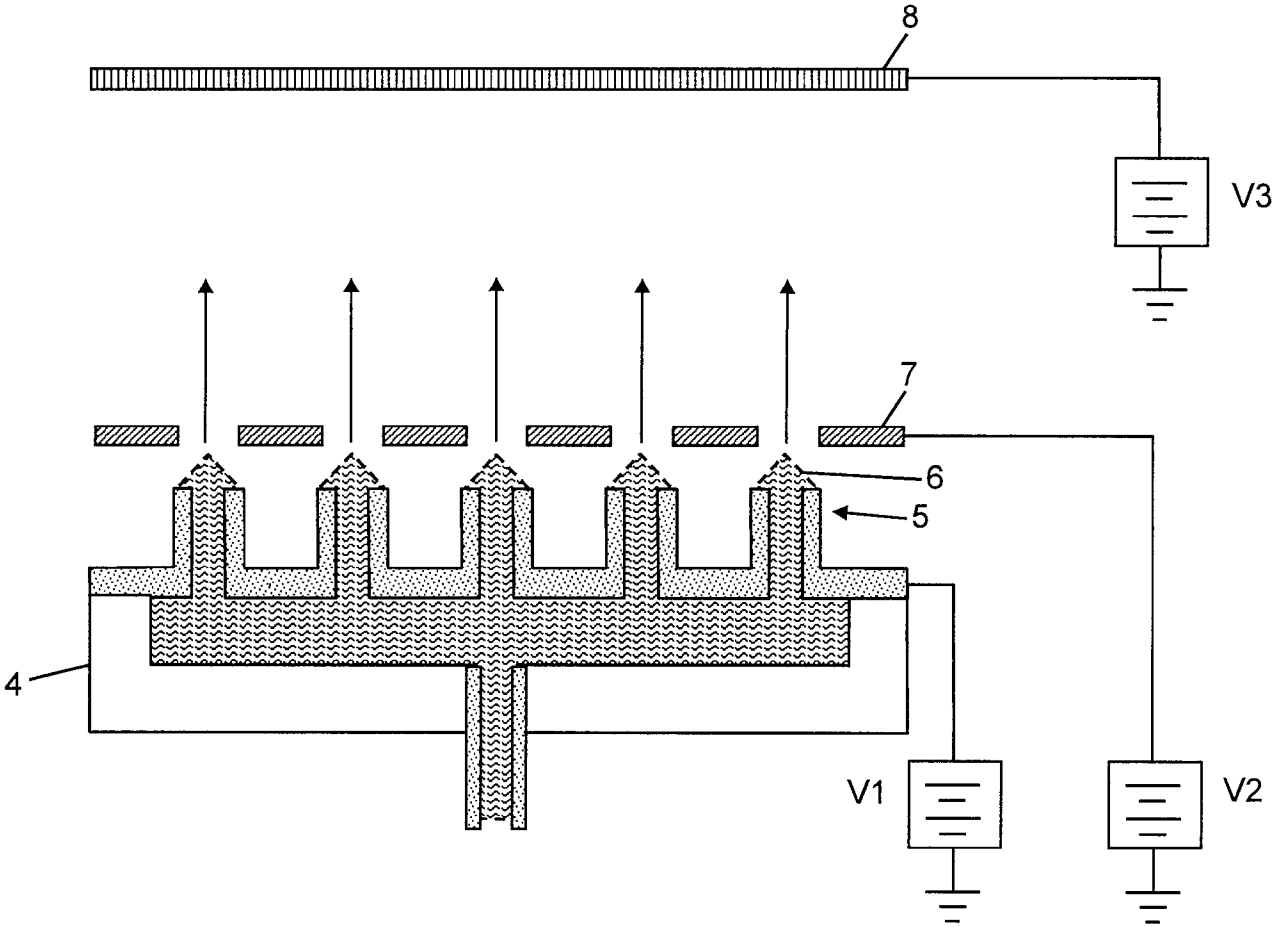
FIG. 1B (Prior Art)
FIG. 1B is a schematic diagram of a known multiplexed electrospray system comprising separate collector and extractor electrodes.
Figures 2A, 2B, 2C:
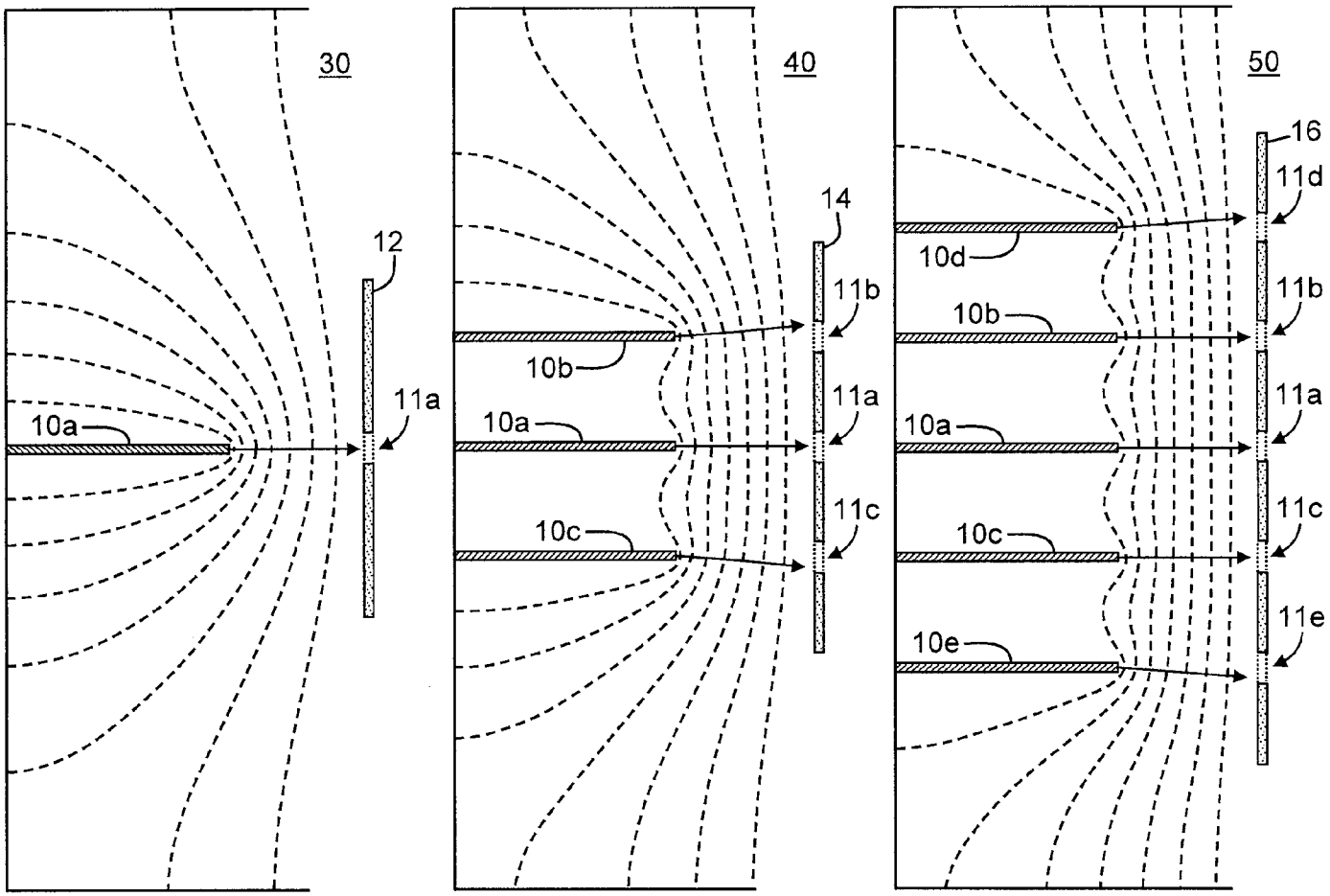
FIGS. 2A-2C are diagrams of calculated field lines (dashed) and emitted ion trajectories (solid arrows) for a conventional single emitter (FIG. 2A) and conventional arrays of three (FIG. 2B) and five (FIG. 2C) emitters.
Figure 3A:
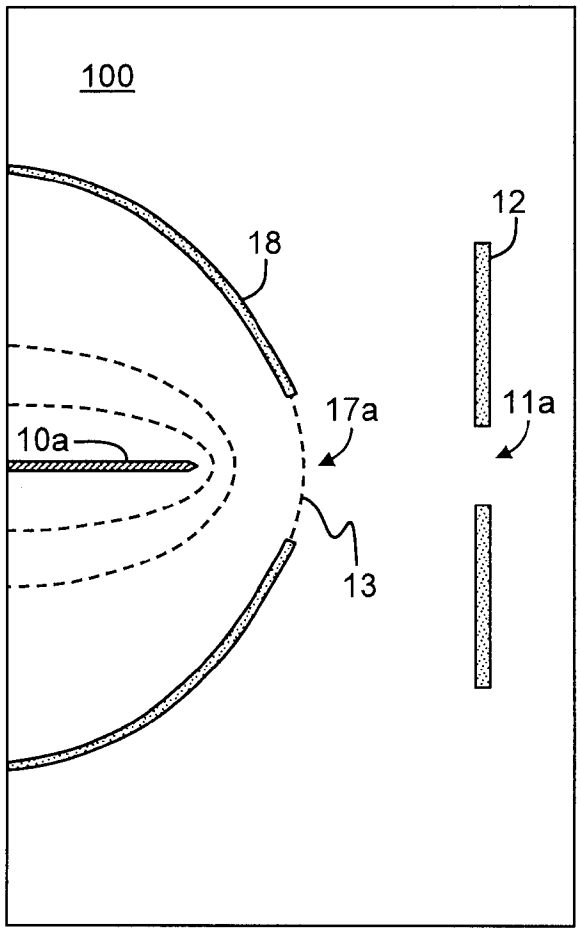
FIG. 3A is a schematic diagram of a single-ion-emitter assembly including a shield electrode in accordance with the present teachings.

FIG. 3A is a schematic cross-sectional diagram of an ion-emitter assembly including a shield electrode in accordance with the present teachings. The single emitter assembly shown in FIG. 3A, as well as the alternative assemblies illustrated in FIGS. 3B-3C, will frequently be used, not as a stand-alone device, but as part of an array of such emitters. The emitter assembly 100 shown in FIG. 3A comprises an emitter capillary electrode 10*a* and a counter electrode 12 having aperture 11*a* as previously described in reference to FIG. 2. The emitter capillary electrode 10*a* may comprise a hollow tube (e.g., a capillary) having an internal bore for transporting the liquid sample from a source and an emitter tip at a capillary end. The emitter capillary electrode 10*a* also comprises an electrode portion for providing a first applied electric potential so as to impart the electrical potential to the liquid sample and to thereby emit charged particles (droplets or ions) from the liquid sample. The electrode portion may comprise a separate electrode in contact with the capillary, a needle electrode within the capillary bore or the capillary, itself.

The counter electrode 12 may, in fact, be a portion of a MS instrument and, in such an instance, the aperture 11*a* may be an ion inlet aperture of the MS. In addition, the emitter assembly 100 comprises a shield electrode 18 disposed between the emitter capillary electrode 10*a* and the counter electrode 12. The shield electrode 18 comprise an aperture or gap 17*a* which is disposed so as to enable ions emitted from the emitter capillary electrode 10*a* to pass on to the aperture 11*a* in the counter electrode 12. Alternatively, the shield electrode 18 may be formed in two or more sections such that the gap 17*a* is the space between such sections.

In three dimensions, the shield electrode 18 shown in FIG. 3A has the approximate shape of a spheroidal cap or spheroidal dome. More generally, the shape of the shield electrode 18 is chosen so as to approximate the shape of a particular iso-electric potential surface 13, as that surface would otherwise exist in the absence of the shield electrode—that is, a surface corresponding to one of the iso-potential surfaces illustrated, for instance, in FIG. 2A. Further, the electric potential applied to the shield electrode is chosen to match the electric potential of the chosen iso-potential surface. Thus, the exact size and shape of and the electric potential applied to the shield electrode 18 depend on the particular iso-potential surface that is chosen since, as is clear from FIG. 2A, different electric potentials correspond to surfaces having different respective sizes and shapes. These iso-potential surfaces are themselves dependent upon apparatus parameters, such as the geometries of the emitter capillary electrode 10*a* and the counter electrode 12. Conceivably, the iso-potential surfaces could be mapped experimentally, but are more readily calculated, for instance, by using a software package such as SIMION 3-D.

Figure 3B:
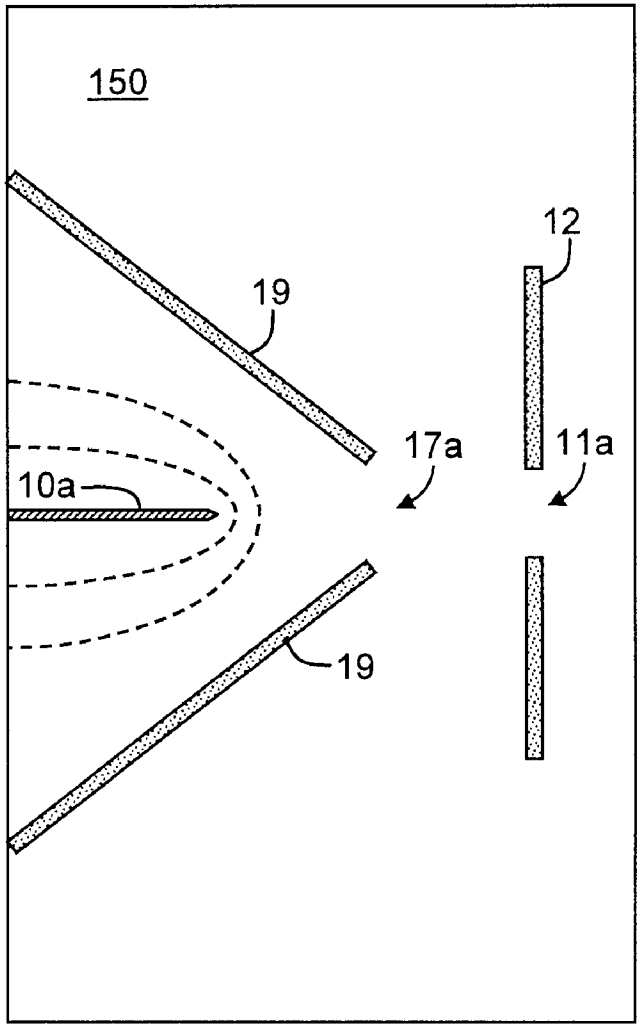
FIG. 3B is a schematic diagram of a second single-ion-emitter assembly including a shield electrode in accordance with the present teachings.

FIG. 3B is a schematic cross-sectional diagram of a second ion-emitter assembly including a shield electrode in accordance with the present teachings. The ion emitter assembly 150 illustrated in FIG. 3B is similar to the assembly illustrated in FIG. 3A except that the spheroidal cap electrode is replace by a shield electrode or electrode assembly 19 that is frusto-conical in shape with a central aperture 17*a* at the cone truncation. The frusto-conical electrode or electrode assembly 19 may provide greater ease of manufacturing than the electrode 18 while still providing improved emitter performance, relative to a conventional system.

Figure 3C:
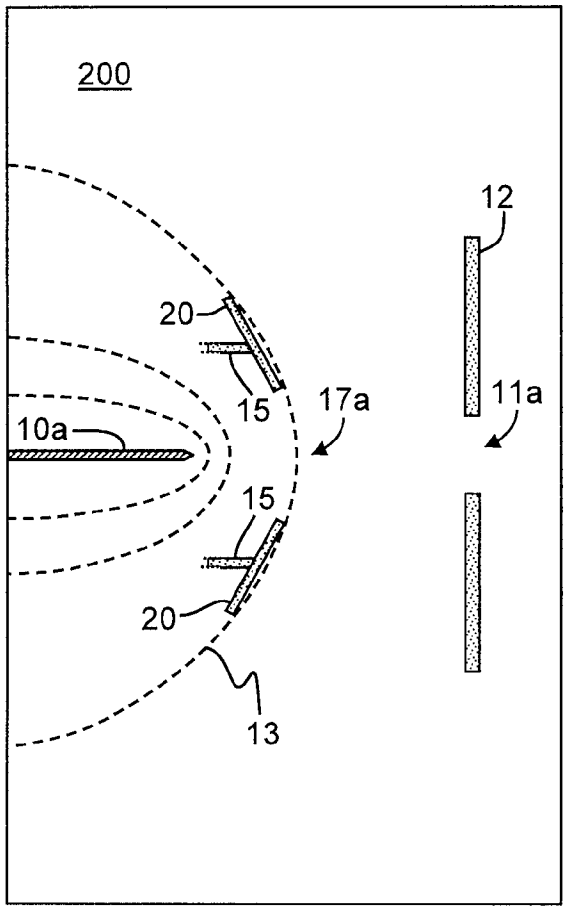
FIG. 3C is a schematic diagram of a third single-ion-emitter assembly including a shield electrode in accordance with the present teachings.

In the apparatus 200 shown in FIG. 3C, the surface of the shield electrode 20 (or, more generally, surfaces of shield electrodes 20) could be chosen to have a simpler shape as compared to the shield electrode 18 shown in FIG. 3A. For instance, the shield electrode or electrodes 20 may comprise one or several of curved or even flat plates which approximately lie on or along a chosen iso-electric potential surface 13. The electrode or electrodes 20 may have relatively simple or easily-manufactured shapes, such as segments of spheres or even a plurality of flat plates. The electrodes may comprise two or more ring structures, possibly asymmetric, which encircle the aperture 17*a*. Each ring structure may comprise a split ring such that the ring stricture comprises a first approximately half-ring separated by a gap from another approximately half ring. Whereas the shield electrode 18 (FIG. 3A) comprises a nearly hemi-ellipsoidal or nearly hemi-spheroidal dome that limits the ability to position additional emitter capillary electrodes close to the illustrated electrode, the electrode or electrodes 20 may be limited in shape or size so that separate emitters may be more closely juxtaposed. For example, the electrode or electrodes 20 may be supported by support structures 15, such as rods that are disposed between and parallel to the emitter capillary electrodes. Such a configuration allows for a closer packaging of a plurality of emitters near the inlet orifice while still providing the functionality of the shielding electrode.

In addition to the considerations discussed above, the particular electrode shape will be determined based on balancing two considerations: size and shape accuracy versus packaging density and simplicity. For example, the apparatus 100 shown in FIG. 3A follows more closely the equipotential surface, whereas the apparatus 200 illustrated in FIG. 3C is simpler to manufacture and provides for closer inter-emitter spacing.

Figure 4A:
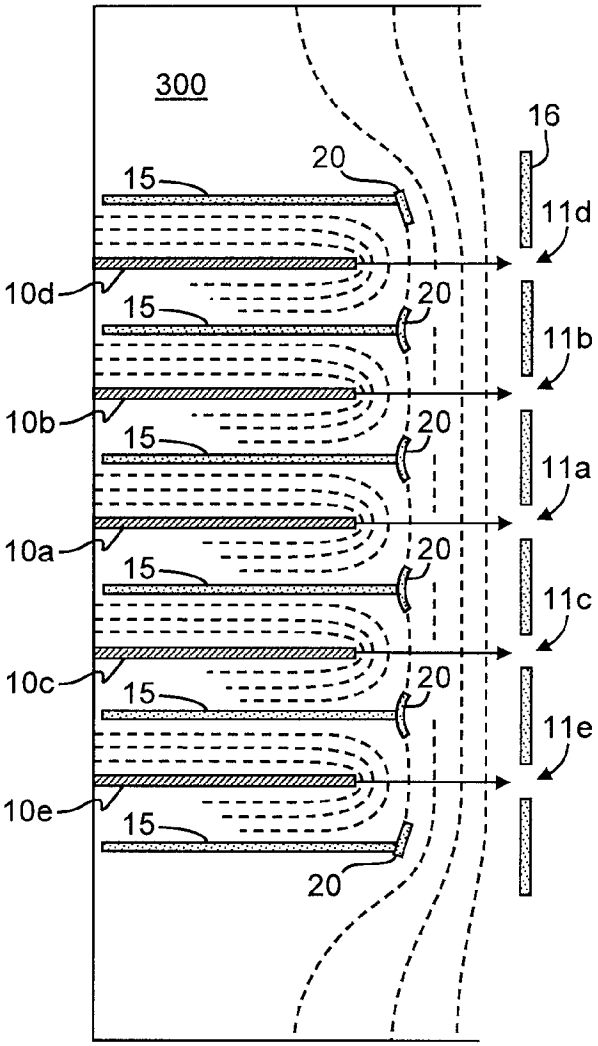
FIG. 4A is a schematic diagram of an emitter array apparatus comprising a linear array of emitters in accordance with the present teachings, including calculated field lines (dashed) and emitted ion trajectories (solid arrows)

FIG. 4A is a schematic cross-sectional diagram of an emitter array apparatus 300 in accordance with the present teachings. In FIG. 4A, calculated iso-electric field surfaces are indicated by dashed lines and trajectories of emitted ions are shown by solid arrows. To facilitate comparison, the configurations and dispositions of the emitter capillary electrodes 10*a*-10*e*, the counter electrode 16 and the counter-electrode apertures 11*a*-11*e* are similar to those shown in FIG. 2C. The apparatus 300 (FIG. 4A) comprises, in addition to the components of the apparatus 50 (FIG. 2C), shield electrodes 20 and electrode support structures 15. The calculation results shown in FIG. 4A assume that each electrode support structure 15 is itself an electrode portion comprising a circular right cylinder (i.e., a rod) disposed either between two emitter capillaries or outward (with regard to a center axial plane of the apparatus) relative to an end capillary. Comparison between FIG. 4A and FIG. 2C shows that field lines around the tips of the emitters between the emitter tips and the counter electrode are returned to the condition of a single emitter capillary (FIG. 2A). Consequently, the ion trajectories from the full plurality of emitters are returned to the condition of a single emitter capillary, with emission substantially non-deflected with respect to an axial dimension of each emitter such that the ions from each emitter pass through an aperture in the counter electrode 16.

As modeled herein, the electrode support structures 15 in the apparatus 300 (FIG. 4A) are electrical leads to the electrodes 20. Thus, because of the potential gradient between the emitter capillary electrodes 10*a*-10*e* and the electrode support structures 15, some of the iso-potential surfaces curve so as to be parallel with the emitter capillary electrodes 10*a*-10*e* in the spaces between these electrodes and the support structures 15. Optionally, in some embodiments, the electrode support structures may be eliminated from the regions between the emitter capillary electrodes. One variation of this concept is to incorporate, into the apparatus 300, a single shield electrode or electrode structure (not shown), disposed substantially perpendicularly to the capillary emitter electrodes and substantially parallel to the chosen iso-potential surface. Such a single electrode may comprise a plurality of contoured segments 20, one or more such segments for each emitter. Such a single shield electrode may be supported at its ends, outside of the region of the emitter capillaries.

Figure 4B:
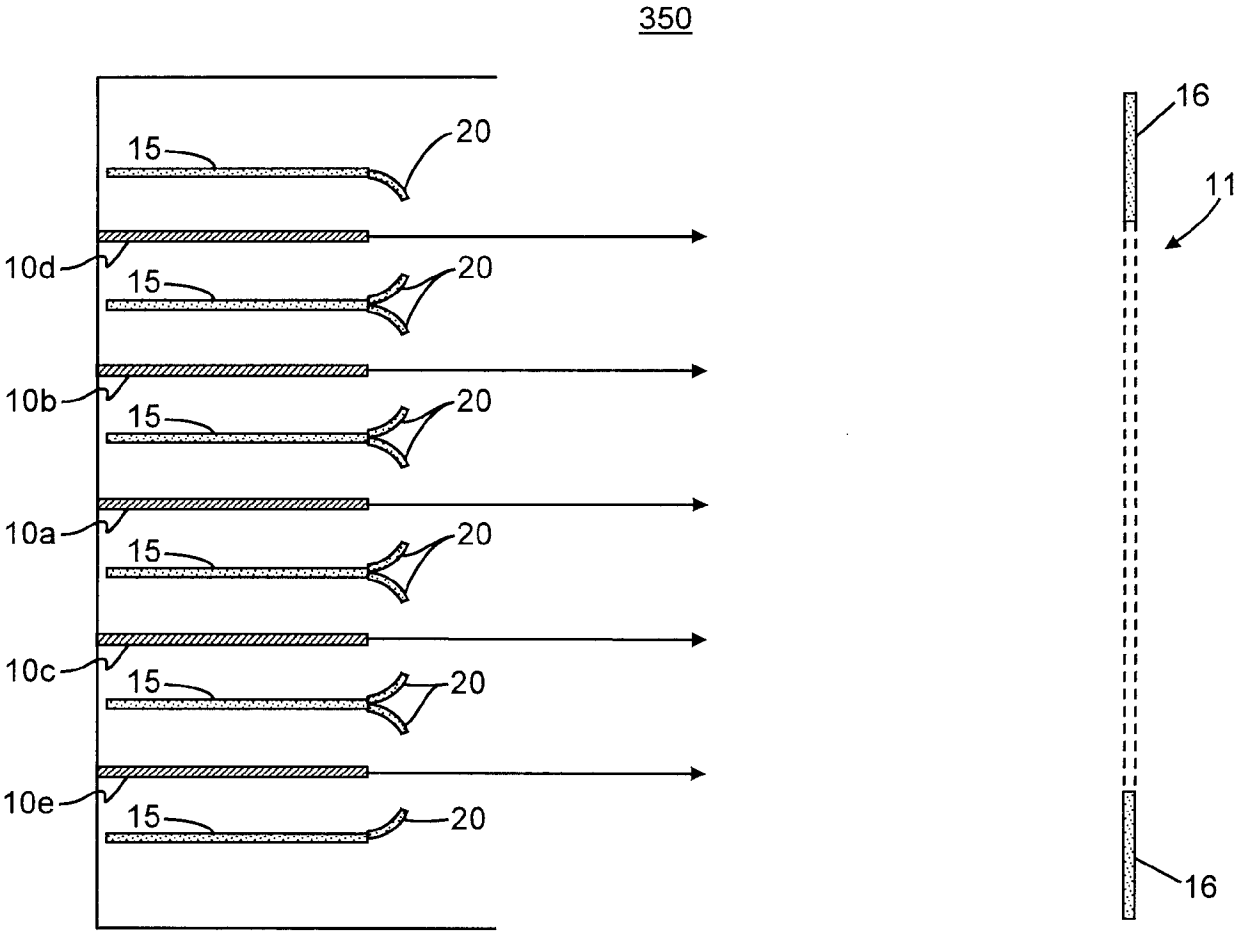
FIG. 4B is a schematic diagram of another emitter array apparatus in accordance with the present teachings.

FIG. 4B is a schematic diagram of another emitter array apparatus in accordance with the present teachings. The apparatus 350 illustrated in FIG. 4B is a variation of the apparatus 300 shown in FIG. 4A. To avoid a confusion of lines, iso-electric potentials are not shown in FIG. 4B. In the apparatus 350 (FIG. 4B), those support structures 15 that are between emitter capillary electrodes 10*a*-10*e* support two or more arcuate or partial spherical or spheroidal shield electrodes 20, with separate such shield electrodes for each neighboring emitter. Further, the ratio, s/d, between the inter-emitter-electrode separation, s, and the distance, d, between the emitter tips and the counter electrode 16 is much smaller than in the apparatus 300. The smaller s/d ratio is such that charged particles from several emitters may be directed to a single aperture 11 in the counter electrode 16. Thus, in general, there need not be a one-to-one correspondence between emitters and counter electrode apertures.

In three dimensions, the arcuate shield electrode 20 may be rotated about an axis within the plane of the drawing and parallel to the arrows of FIG. 4B, so as to form partial dome structures slightly "above" and possibly slightly between the emitter capillary electrodes. (In this sense, the term "above" refers to the spatial region between the emitter tips and the counter electrode 16.) Such dome structured electrodes can enable emitter packing in two dimensions.

Figure 5A:
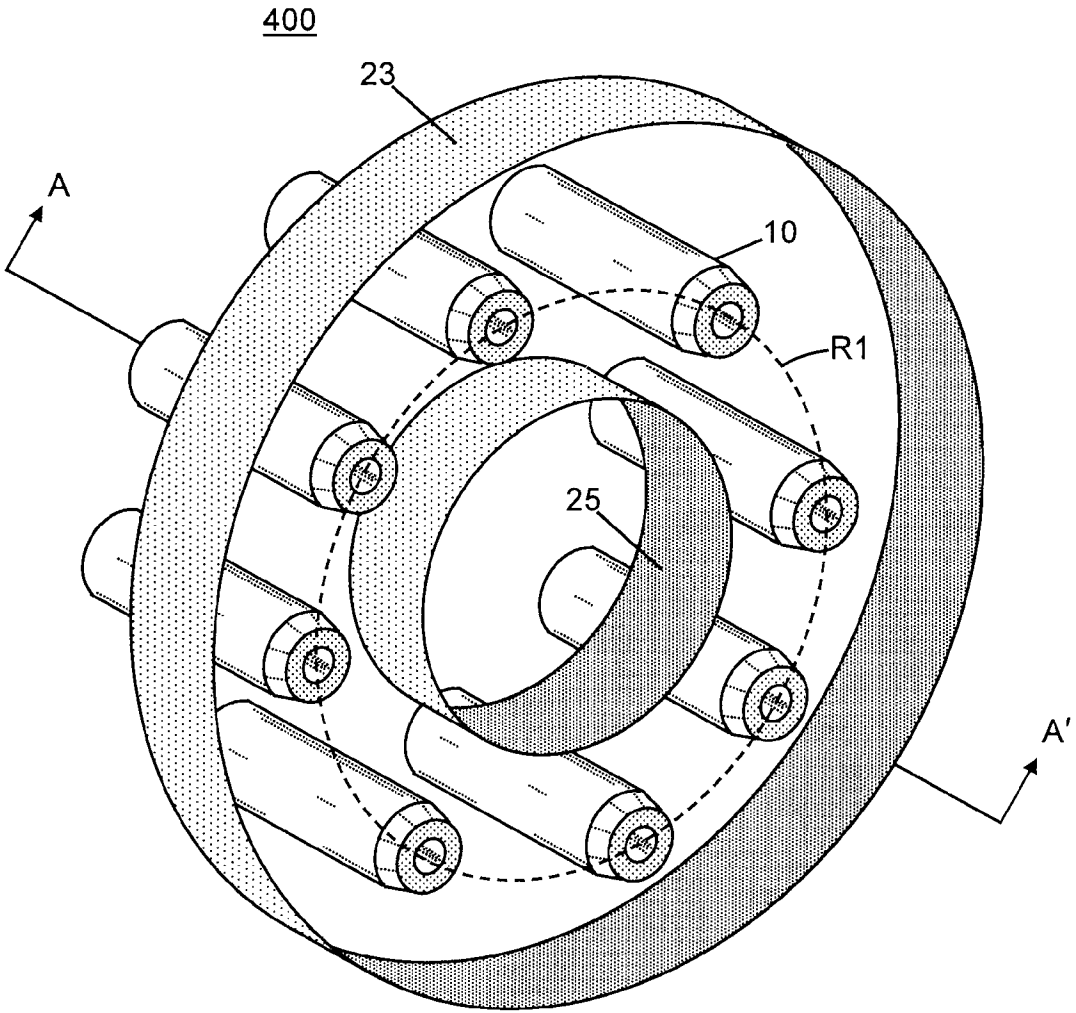
FIG. 5A is a schematic perspective drawing of a first emitter array apparatus comprising an array of emitters configured in a circle in accordance with the present teachings.

FIG. 5A is a schematic perspective drawing of a first emitter array apparatus, apparatus 400, comprising an array of emitters configured in a circle. Here, the phrase "configured in a circle" refers to a configuration in which the centers of the tips of the emitter capillary electrodes 10 lie along a circle when viewed in cross section. For aid in visualizing the apparatus shown in FIG. 5, the circle in question is indicated by dashed curve R1, this curve not to be considered as a part of the apparatus. Although a circular configuration is illustrated, one of ordinary skill in the art will readily appreciate that the emitters may be configured in many alternative geometric patterns, such as a square, an ellipse, or some other shape. The configuration shown in FIG. 5A could also be described as "cylindrical" since an inner bore of a cylinder could be circumscribed around the emitter capillary electrodes 10. The apparatus 400 further comprises a first (outer) ring electrode 23 disposed at least partially exteriorly to the array of emitters and a second (inner) ring electrode 25 disposed at least partially interiorly to the array of emitters.

Figure 5B:
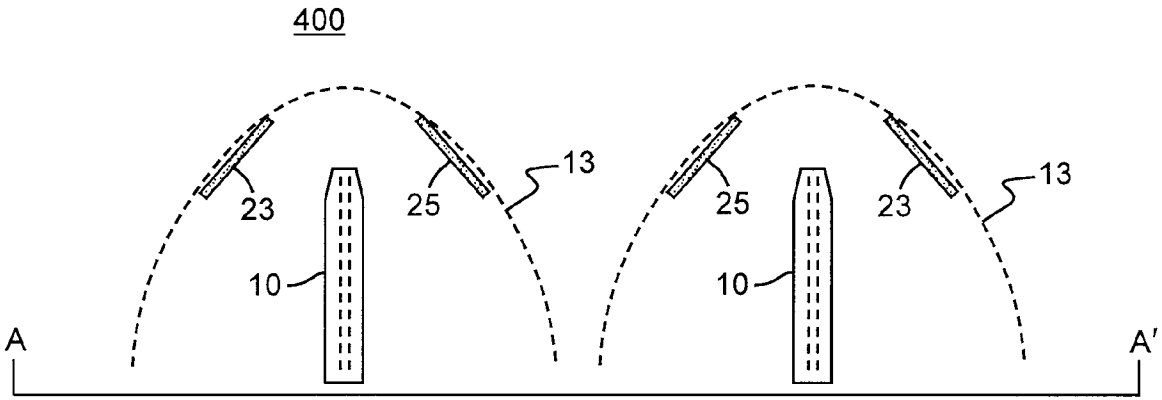
FIG. 5B is cross sectional view through the apparatus of FIG. 5A.
Figure 5C:
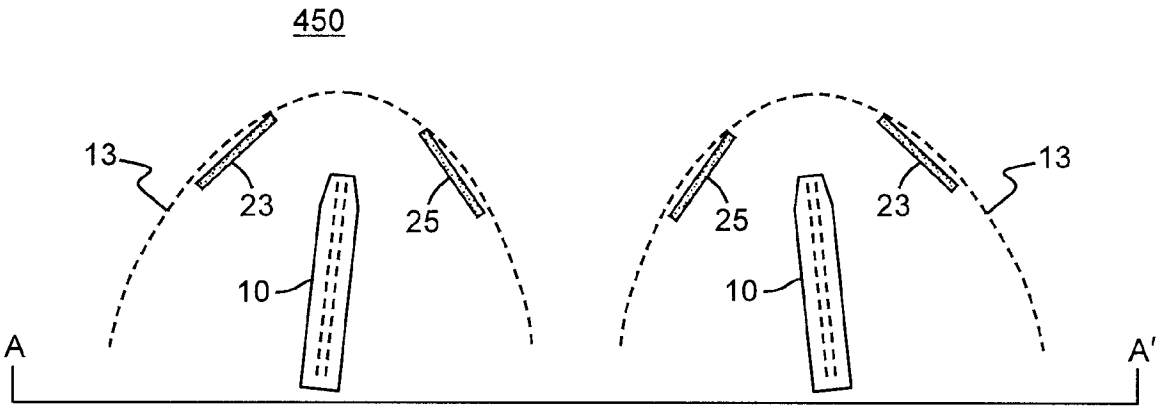
FIG. 5C is a cross sectional view of an emitter array apparatus that is a variant of the apparatus of FIG. 5A.

As may be more readily observed in FIG. 5B, which is a cross-section through the apparatus 400 along section A-A', the outer ring electrode 23 and the inner ring electrode 25 lie approximately along iso-electric potential surfaces 13 as discussed previously. Thus, the inner and outer electrodes are maintained at a same electric potential—the electric potential of the hypothetical iso-electric potential surface. As further shown in FIG. 5C, in a slightly modified apparatus 450, the emitters may be angled inward, towards the center of the emitter array, so as to physically assist in directing the electrospray from the various emitters towards a common focal region.

Figure 6A:
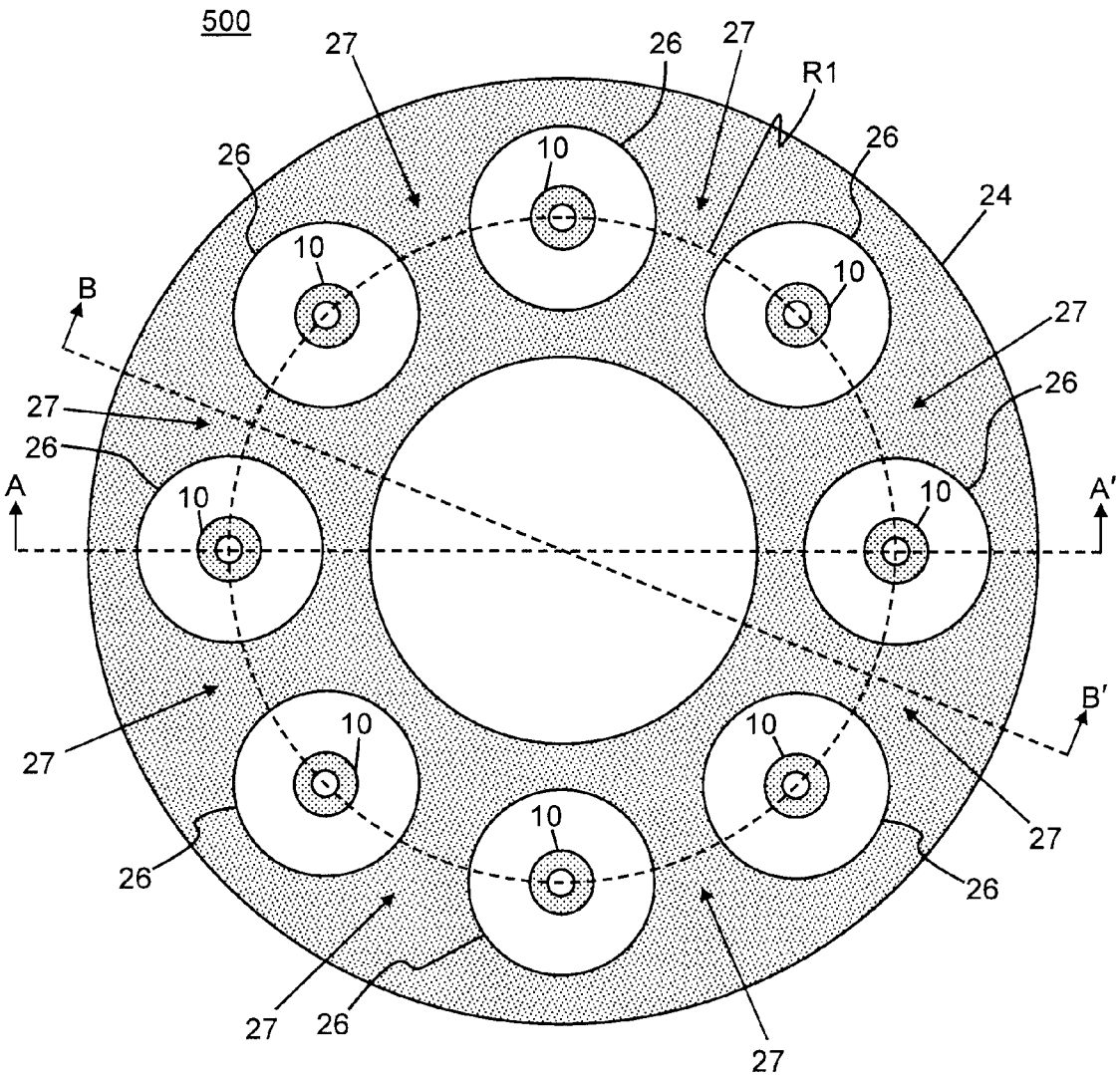
FIG. 6A is a schematic plan view of another emitter array apparatus comprising an array of emitters configured in a circle in accordance with the present teachings.
Figure 6B:
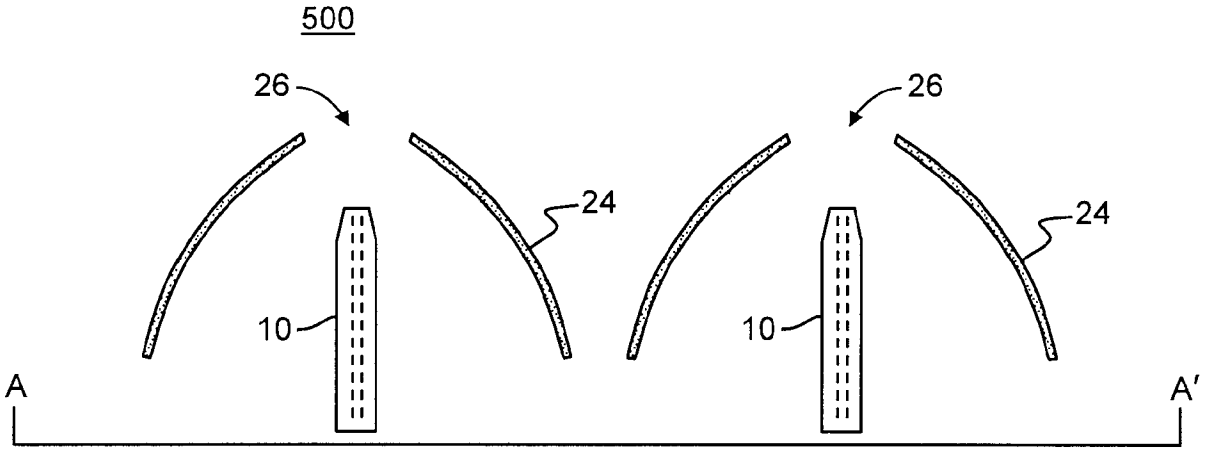
FIG. 6B is cross sectional view through the apparatus of FIG. 6A.
Figure 6C:
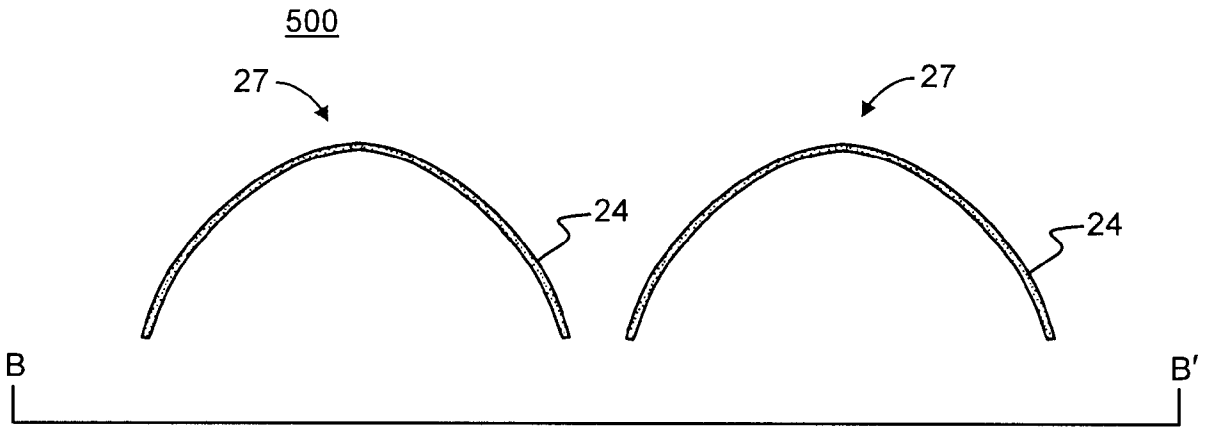
FIG. 6C is a second cross sectional view through the apparatus of FIG. 6A.

In order to further electrically shield the charged particles that are electrosprayed from each emitter 10 from the electric fields surrounding adjacent emitters, the separate inner and outer ring electrodes may be merged into a single ring electrode 24 as illustrated in FIG. 6A, which is a schematic plan view of another emitter array apparatus. Apertures within the ring electrode 24 are aligned with respective emitters 10 in order to provide passageways for electrosprayed charged particles. These apertures are separated from one another by bridge regions 27 which physically and electrically connect the inner and outer portions of the ring electrode 24. The electrode 24 may be conveniently manufactured by bending a single metal foil or sheet that has previously had apertures formed therein by a stamping process. In cross section, the electrode 24 may be dome-shaped or partially dome-shaped, as is illustrated in FIGS. 6A and 6B, which show cross sectional views along section lines A-A' and B-B', respectively. In some embodiments, the bridge regions may comprise complex saddle shapes.

Figure 7:
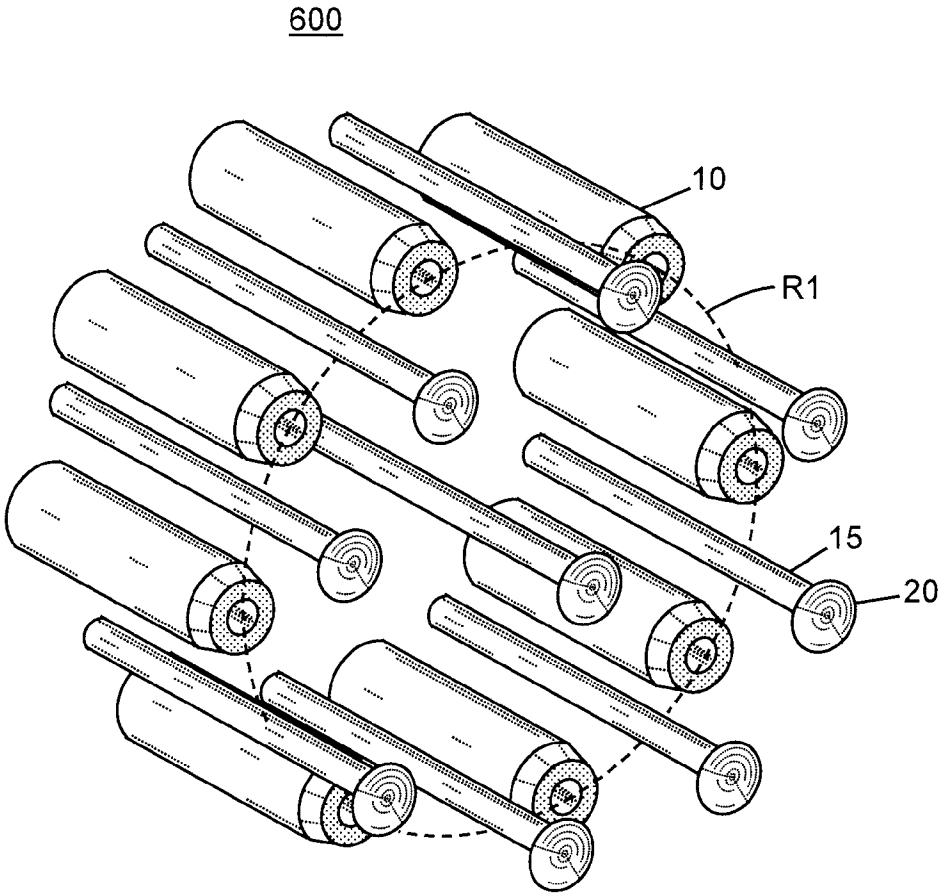
FIG. 7 is a schematic perspective drawing of a yet another emitter array apparatus comprising an array of emitters configured in a circle in accordance with the present teachings.

FIG. 7 is a schematic perspective view of yet another emitter array apparatus, apparatus 600, comprising an array of emitters configured in a circle. In the particular emitter array apparatus 600 shown in FIG. 7, the geometric projections, parallel to the common axes of the emitters 10, of the positions of the shield electrodes 20 onto the plane of the circle R1 are such that each such projected position resides at least partially between two of the emitters 10. Thus, the apparatus 600 comprises at least as many shield electrodes 20 as emitters 10.

The shield electrodes 20 of the apparatus 600 are disposed in a spatial region that is outward from the plane described by the emitter tips, the term "outward" referring to a spatial region that is between the emitter tips and a counter electrode (not shown). Each shield electrode 20 shown in FIG. 7 approximates a portion of the form of an iso-electrical equipotential surface as described previously. Convenient approximating surface shapes may be flat surfaces of plates, or as shown in FIG. 7, cones. Each such shield electrode may be supported by a respective support structure (such as a rod) 15, these support structures being interspersed with the emitter capillary electrodes 10. In the example shown in FIG. 5, eight shield electrodes 20 are provided on respective support structures that pass through the circle indicated by R1 and a ninth shield electrode 20 is provided on a support structure that passes through the center of the circle indicated by R1.

Improved methods and apparatuses for multiple electrospray emitter arrays have been disclosed. The discussion included in this application is intended to serve as a basic description. Neither the description nor the terminology is intended to limit the scope of the invention. The reader should be aware that the specific discussion may not explicitly describe all embodiments possible; many alternatives are implicit. For instance, although multiple apertures are illustrated in a counter electrode, it is possible to configure several emitters sufficiently close to one another such that the ion emission from the plurality is directed to a single aperture.

Further, each feature or element can actually be representative of a broader function or of a great variety of alternative or equivalent elements. Again, these are implicitly included in this disclosure. Thus, a variety of changes may be made without departing from the essence of the invention. Such changes are also implicitly included in the description.

Finally, note that any publications, patents or patent application publications mentioned in this specification are explicitly incorporated by reference in their respective entirety.

What is claimed is:

1. An electrospray ion source for generating ions from a liquid sample for introduction into a mass spectrometer comprising:

an emitter capillary comprising:

an internal bore for transporting the liquid sample from a source;

an electrode portion for providing a first applied electric potential; and an emitter tip for emitting charged particles generated from the liquid sample;

a counter electrode for providing a second applied electric potential different from the first applied electric potential; and a shield electrode disposed at least partially between the counter electrode and the emitter tip of the emitter capillary for providing a third applied electric potential intermediate to the first and second applied electric potentials, the shield electrode contoured in the form of a portion of an electric equipotential surface formed, in the absence of the shield electrode, under application of the first and second applied electric potentials to the electrode portion of the emitter capillary and to the counter electrode, respectively.

2. An electrospray ion source as recited in claim 1, further comprising an aperture in the shield electrode for providing a pathway for motion of the charged particles.

3. An electrospray ion source as recited in claim 1, further comprising an electrode support structure substantially parallel to the emitter capillary.

4. An electrospray ion source apparatus for generating ions from a liquid sample for introduction into a mass spectrometer comprising:

a plurality of emitter capillaries, each comprising:

an internal bore for transporting a portion of the liquid sample from a source;

an electrode portion for providing a first applied electric potential; and an emitter tip for emitting charged particles generated from the liquid sample portion;

a counter electrode for providing a second applied electric potential different from the first applied electric potential; and at least one shield electrode disposed at least partially between the counter electrode and the emitter tip of at least one of the emitter capillaries for providing a third applied electric potential intermediate to the first and second applied electric potentials, wherein the at least one shield electrode is configured such that provision of the third applied electric potential to the at least one shield electrode provides a uniformity of emission of charged particles from the plurality of emitter tips.

5. An electrospray ion source apparatus as recited in claim 4, wherein the at least one shield electrode is contoured in the form of a portion of an electric equipotential surface created under application of the first and second applied electric potentials to the electrode portion of a single isolated emitter capillary and to the counter electrode, respectively.

6. An electrospray ion source apparatus as recited in claim 4, wherein the uniformity of emission comprises a uniformity of direction of emission of charged particles from the plurality of emitter tips.

7. An electrospray ion source apparatus as recited in claim 4, wherein the uniformity of emission comprises a uniformity of kinetic energy of charged particles comprising a common mass-to-charge ratio.

8. An electrospray ion source apparatus as recited in claim 4, wherein the uniformity of emission comprises a uniformity of rate of emission of charged particles from the plurality of emitter tips.

9. An electrospray ion source apparatus as recited in claim 4, wherein a shield electrode is shaped in the form of an ellipsoidal cap or spheroidal cap.

10. An electrospray ion source apparatus as recited in claim 4, wherein a shield electrode comprises a frusto-conical surface.

11. An electrospray ion source apparatus as recited in claim 4, wherein the at least one shield electrode comprises:

a first ring electrode disposed at least partially exteriorly to the plurality of emitter capillaries; and a second ring electrode disposed at least partially interiorly to the plurality of emitter capillaries.

12. An electrospray ion source apparatus as recited in claim 4, wherein the at least shield electrodes comprises a single ring electrode disposed at least partially exteriorly and at least partially interiorly to the plurality of emitter capillaries.

13. An electrospray ion source apparatus as recited in claim 4, wherein the at least one shield electrode comprises an aperture for providing a pathway for motion of the charged particles emitted from the respective one of the emitter capillaries.

14. An electrospray ion source apparatus as recited in claim 4, wherein a shield electrodes comprises a flat plate.

15. An electrospray ion source as recited in claim 4, further comprising a plurality of electrode support structures disposed substantially parallel to the emitter capillaries, each electrode support structure physically coupled to a respective one of the shield electrodes.

16. A method for providing ions to a mass spectrometer, comprising:

(a) providing a source of analyte-bearing liquid;

(b) providing a plurality of an electrospray emitter capillaries, each comprising:

an internal bore for transporting the analyte-bearing liquid from the source;

an electrode portion; and an emitter tip for emitting charged particles generated from the analyte-bearing liquid;

(c) providing a counter electrode;

(d) providing at least one shield electrode disposed at least partially between the counter electrode and the emitter tip of at least one of the emitter capillaries;

(e) distributing the analyte-bearing liquid among the plurality of electrospray emitter capillaries; and (f) providing first, second and third electric potentials, respectively, to the plurality of electrode portions of the electrospray emitter capillaries, the counter electrode and the at least one shield electrode, wherein the third electric potential is intermediate to the first and second electric potentials, such that the charged particles are emitted from each of the emitter tips, wherein the at least one shield electrode is configured such that provision of the third electric potential provides a uniformity of emission of charged particles from the plurality of emitter tips.

17. A method for providing ions to a mass spectrometer as recited in claim 16, wherein the step of providing the at least one shield electrode comprises configuring the at least one shield electrode such that the uniformity of emission comprises a uniformity of direction of emission of charged particles from the plurality of emitter tips.

18. A method for providing ions to a mass spectrometer as recited in claim 16, wherein the step of providing the at least one shield electrode comprises configuring the at least one shield electrode such that the uniformity of emission comprises a uniformity of kinetic energy of charged particles comprising a common mass-to-charge ratio.

19. A method for providing ions to a mass spectrometer as recited in claim 16, wherein the step of providing the at least one shield electrode comprises configuring the at least one shield electrode such that the uniformity of emission comprises a uniformity of rate of emission of charged particles from the plurality of emitter tips.

20. A method for providing ions to a mass spectrometer as recited in claim 16, wherein the step of providing the at least one shield electrode comprises configuring a shield electrode in the form of a portion of an electric equipotential surface created under application of the first and second electric potentials to the electrode portion of a single isolated emitter capillary and to the counter electrode, respectively.

21. A method for providing ions to a mass spectrometer as recited in claim 16, further comprising:

providing a plurality of electrode support structures disposed substantially parallel to the emitter capillaries, each electrode support structure physically coupled to a respective one of the shield electrodes.

22. A method for providing ions to a mass spectrometer as recited in claim 16, wherein the step of providing the at least one shield electrode comprises providing a first ring electrode disposed at least partially exteriorly to the plurality of emitter capillaries and a second ring electrode disposed at least partially interiorly to the plurality of emitter capillaries.

23. A method for providing ions to a mass spectrometer as recited in claim 16, wherein the step of providing the at least one shield electrode comprises providing a single ring electrode disposed at least partially exteriorly and at least partially interiorly to the plurality of emitter capillaries.

24. A method for providing an electrospray ion emitter apparatus for generating charged particles from a liquid sample, comprising:

(a) providing a first emitter capillary comprising:
an internal bore;
an electrode portion; and
an emitter tip;

(b) providing a counter electrode at a distance from the emitter tip;

(c) determining a form of an electrical equipotential surface created around the electrospray emitter capillary under application of a first and a second electric potential to the electrode portion of the electrospray emitter capillary and to the counter electrode, respectively;

(d) providing at least one additional emitter capillary disposed parallel to the first emitter capillary, each additional emitter capillary comprising:
an internal bore;
an electrode portion; and
an emitter tip; and (e) providing at least one shield electrode, each shield electrode approximating a portion of the form of the electrical equipotential surface and disposed at least partially between the counter electrode and the emitter tip of the first emitter capillary or the at least one additional emitter capillary.

25. A method for providing an electrospray ion emitter apparatus as recited in claim 24, wherein the step (e) of providing at least one shield electrode includes providing a shield electrode that is disposed at least partially between the counter electrode and the emitter tips of two or more of the emitter capillaries.

26. A method for providing an electrospray ion emitter apparatus as recited in claim 24, wherein the step (e) of providing at least one shield electrode includes providing a shield electrode that is shaped in the form of an ellipsoidal cap or spheroidal cap.

27. A method for providing an electrospray ion emitter apparatus as recited in claim 24, wherein the step (e) of providing at least one shield electrode includes providing a shield electrode that comprises a frusto-conical surface.

28. A method for providing an electrospray ion emitter apparatus as recited in claim 24, wherein the step (e) of providing at least one shield electrodes includes providing a ring electrode.

* * * * *